US010463111B2

(12) United States Patent
Przirembel et al.

(10) Patent No.: US 10,463,111 B2
(45) Date of Patent: Nov. 5, 2019

(54) SHOE TREE

(71) Applicants: Hans R. Przirembel, Monterey, TN (US); Scott Alan Przirembel, Monterey, TN (US)

(72) Inventors: Hans R. Przirembel, Monterey, TN (US); Scott Alan Przirembel, Monterey, TN (US)

( * ) Notice: Subject to any disclaimer, the term of this patent is extended or adjusted under 35 U.S.C. 154(b) by 0 days.

(21) Appl. No.: 15/940,791

(22) Filed: Mar. 29, 2018

(65) Prior Publication Data

US 2019/0298004 A1 Oct. 3, 2019

(51) Int. Cl.
*A43D 3/00* (2006.01)
*A43D 3/14* (2006.01)

(52) U.S. Cl.
CPC ..... *A43D 3/145* (2013.01); *A43D 3/1433* (2013.01); *A43D 3/1475* (2013.01)

(58) Field of Classification Search
CPC ..... A43D 3/1433; A43D 3/145; A43D 3/1475
USPC ..... 12/114.2, 114.4, 114.6
See application file for complete search history.

(56) References Cited

U.S. PATENT DOCUMENTS

| | | | | | |
|---|---|---|---|---|---|
| 601,306 | A * | 3/1898 | Rutgers | A43D 3/04 | 12/114.4 |
| 795,217 | A * | 7/1905 | Gaunt | A43D 3/04 | 12/114.4 |
| 1,160,631 | A * | 11/1915 | Magnus | A43D 3/04 | 12/114.4 |
| 1,271,547 | A * | 7/1918 | Delaney | A43D 3/04 | 12/114.4 |
| 1,792,192 | A * | 2/1931 | Sordelett | A43D 3/04 | 12/114.4 |
| 3,193,861 | A * | 7/1965 | Howard | A43D 3/1466 | 12/114.4 |
| 5,341,532 | A * | 8/1994 | Markowitz | A43D 3/04 | 12/114.4 |
| 2006/0005328 | A1* | 1/2006 | Johnson | A43D 3/1433 | 12/128 R |
| 2006/0207039 | A1* | 9/2006 | Huang | A43D 3/1433 | 12/128 R |
| 2019/0055076 | A1* | 2/2019 | Wetsch | A43D 3/04 | |

* cited by examiner

*Primary Examiner* — Marie D Bays
(74) *Attorney, Agent, or Firm* — Inventa Capital PLC

(57) ABSTRACT

A shoe tree includes a body having a toe member that has a distal tip end and a proximal end. The toe member is insertable into a toe portion of a respective shoe and formed to support the toe portion of the shoe. The shoe tree also includes a heel member that is insertable into a heel portion of the respective shoe and formed to support the heel portion thereof. The body is hollow inside and presents a neck portion of tubular member to receive and store fluids like liquids to add weight to the shoe tree to spread the weight of the shoe tree to the respective shoe to keep the shoe in shape at all times.

9 Claims, 9 Drawing Sheets

SHOE TREE

FIELD OF THE INVENTION

The present invention generally relates to an article of a footwear and more specifically to a shaping device for the article of footwear designed to maintain the shape thereof.

BACKGROUND OF THE INVENTION

As appreciated by those skilled in the art, shoe trees are typically made of solid blocks of wood, a combination of wood and metal, or metal alone, all of which can be heavy, expensive to manufacture, complex to use, and bulky to pack when traveling. As also appreciated by those skilled in the art, as the shoe trees made of wood are washed, they take considerable time to dry and must be completely dry before they can be reused to prevent deterioration of such shoe tree.

Other prior art shoe trees are adjustable and require the use of metal springs to give the shoe tree flexibility, or require the use of some type of compression component or spacer bar to facilitate the insertion and removal of the shoe tree from a shoe. Such springs, compression components, and spacer bars increase the manufacturing costs of such shoe trees, increase the complexity of manufacture, and increase the possibility of breakage or malfunctioning of the shoe trees.

One of the prior art designs of the shoe tree includes a shoe tree and an electrically operated disinfecting device such as an ultraviolet light emitting lamp. The shoe tree is inserted in a shoe and the disinfecting lamp inhibits the growth of fungi and other microorganisms, particularly those which cause athlete's foot or unpleasant odor. A control box for operating the lamp can include a timer and ballast.

Another prior art design includes a shaping apparatus for an article of footwear is provided to maintain the shape of the shoe. An insertable apparatus includes a toe shaping member. A medial shaping member may engage a medial side of the upper. A lateral shaping member may engage a lateral side of the upper. The medial shaping member and lateral shaping member are resiliently disposed on the toe shaping member. A rear biasing member may be attached to the medial shaping member and the lateral shaping member.

Still another prior art design is directed to an inflatable shoe tree that is easy to inflate and that is highly suitable for use both at home and for travel and includes a unitary body having, an interior gas tight chamber, a toe portion, a heel portion, a central portion between the toe portion and the heel portion, a bottom portion, a top portion, and an inflation portion that allows for a volume of gas to enter and exit the gas tight chamber. The body is capable of being in an inflated position and a deflated position, and when in an inflated position it forms a preformed three-dimensional structure substantially in the shape of a human foot, and when the shoe tree is in a fully deflated position, it is substantially flat in shape.

Accordingly, there is a need for a unique shoe tree that overcomes the problems associated with known prior art shoe trees.

Another object is to provide an economical and cost-effective design of a shoe tree.

These and other problems have been solved by the improved system and method described below.

SUMMARY OF THE INVENTION

A shoe tree is insertable into a respective shoe and is formed to support the shoe. The shoe tree includes a body formed from a polymeric material and has a toe part insertable into a toe portion of the shoe and formed to support the toe portion of the shoe and a heel part that is insertable into a heel portion of the respective shoe and formed to support the heel portion thereof. The toe part and the heel part each present a toe bottom portion and a heel bottom portion separated by a step portion. The toe part presents a wedge shaped side wall extending to a neck portion. The neck portion includes first connectors to mate with second connectors of a cap to engage the cap with the neck portion to keep fluids inside the shoe tree. The wedge shaped side wall extends to a flat section at the heel bottom portion to stabilize the shoe tree when it is inserted into the shoe.

Alluding to the above, the toe part presents side parts defining wings extending above and outwardly from sides panels to form a grabbing portions on each side of the toe part to allow a user to grab the body and insert the body of the shoe tree into the shoe. The handle presents a semi-circular peripheral edge to mate with the shoe. The body is hollow in shape and defines a handle being integral with and extending from the toe part and a neck portion of tubular configuration positioned below the handle. The handle extends below the neck portion with the neck portion adaptable to receive and store fluids to add weight to the shoe tree to spread the weight of the shoe tree to the shoe to keep the shoe in shape and eliminate wrinkles on the shoe.

An advantage of the present invention is to provide a shoe tree apparatus with members that are insertably configured for maintaining the shape of an upper of an article of footwear.

Another advantage of the present invention is to provide a shoe tree adaptable for storing liquids and using liquids during travel while the shoe tree is inside a shoe and apply weight inside the shoe to keep the shoe in shape and stretch out all wrinkles.

Still another advantage of the present invention is to provide a shoe tree that is light in weigh and easy to manufacture.

Other advantages and meritorious features of this invention will be more fully understood from the following description of the preferred embodiment, the appended claims, and the drawings, a brief description of which follows. These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
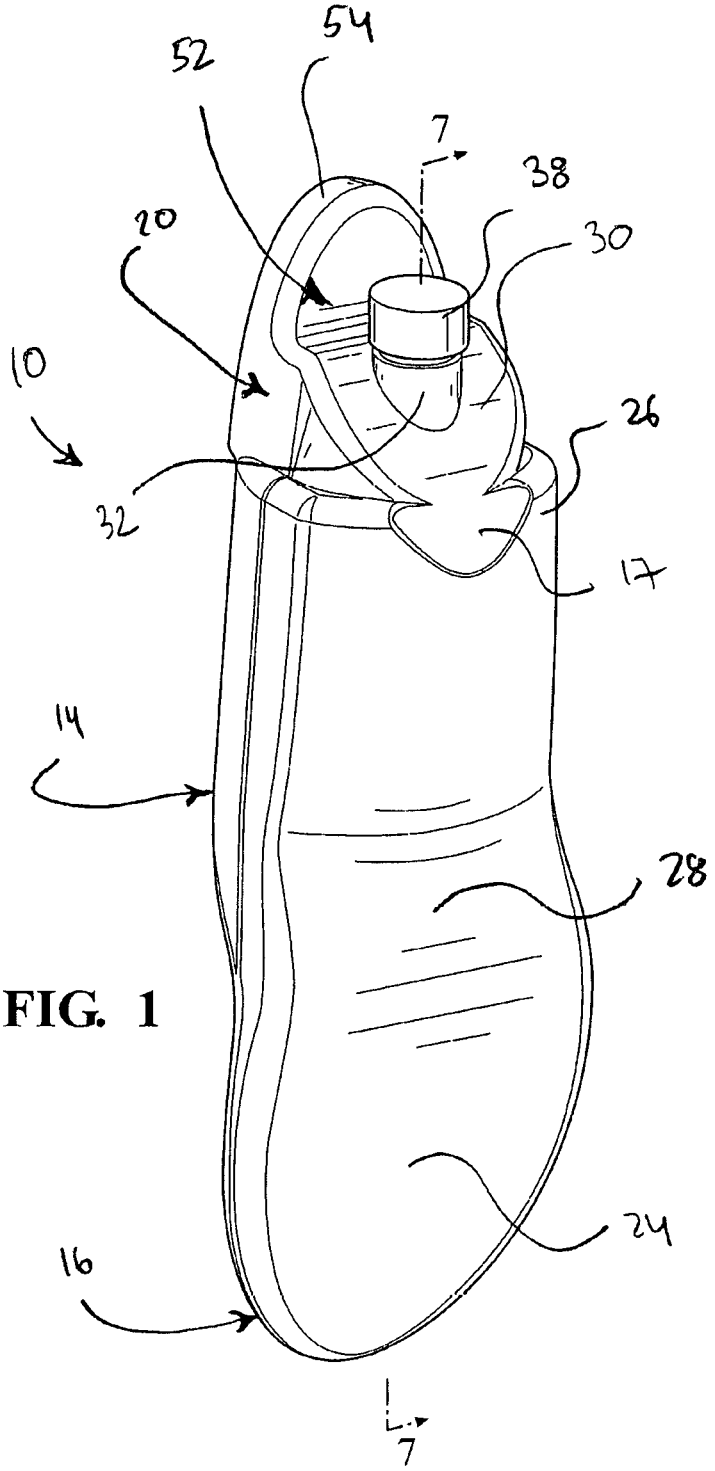
FIG. 1 illustrates a perspective view of a shoe tree taken from a bottom part.
Figure 2:
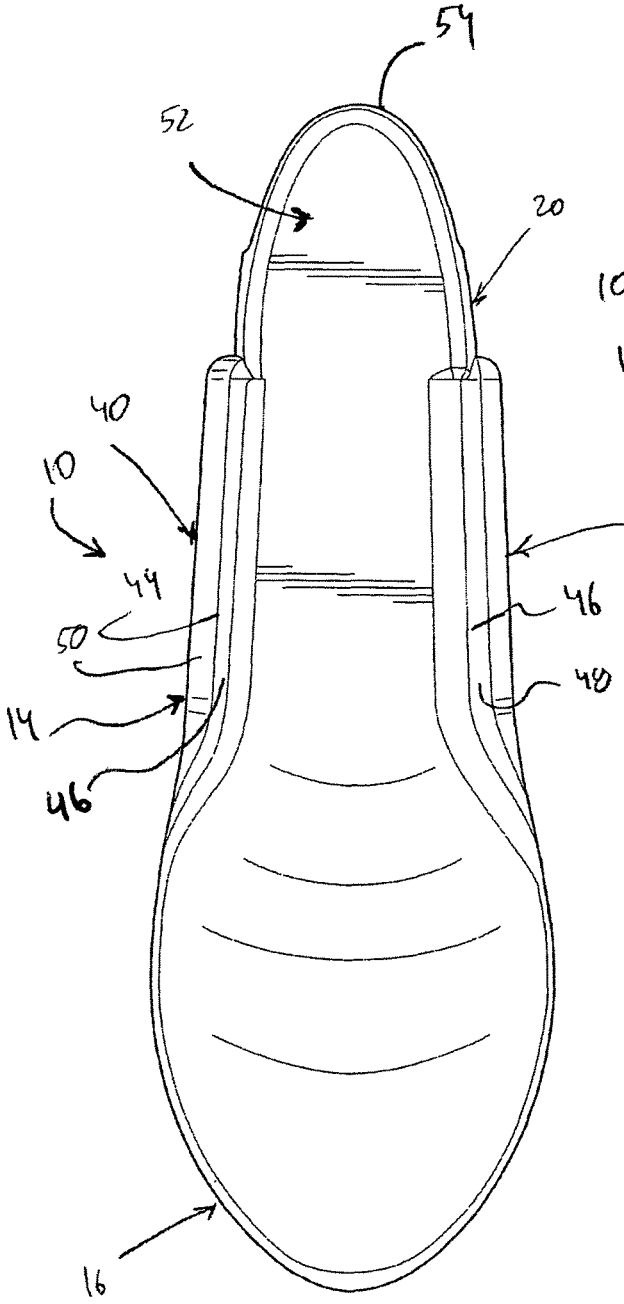
FIG. 2 illustrates a top view of the shoe tree.
Figure 3:
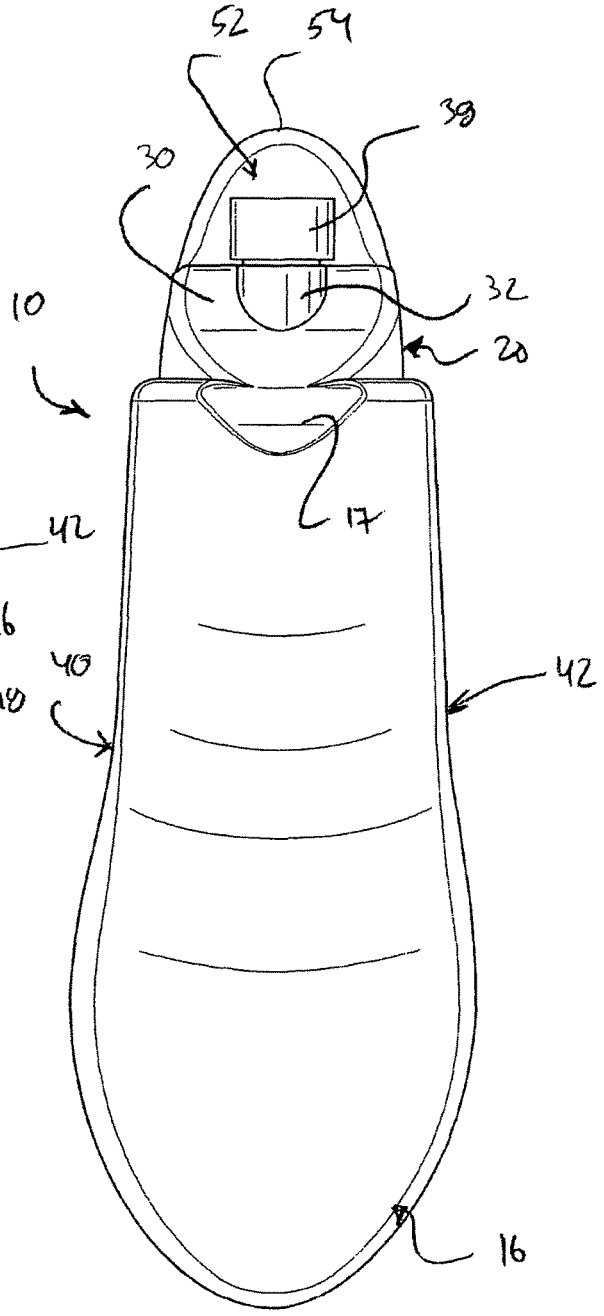
FIG. 3 illustrates a bottom view of the shoe tree.
Figure 4:
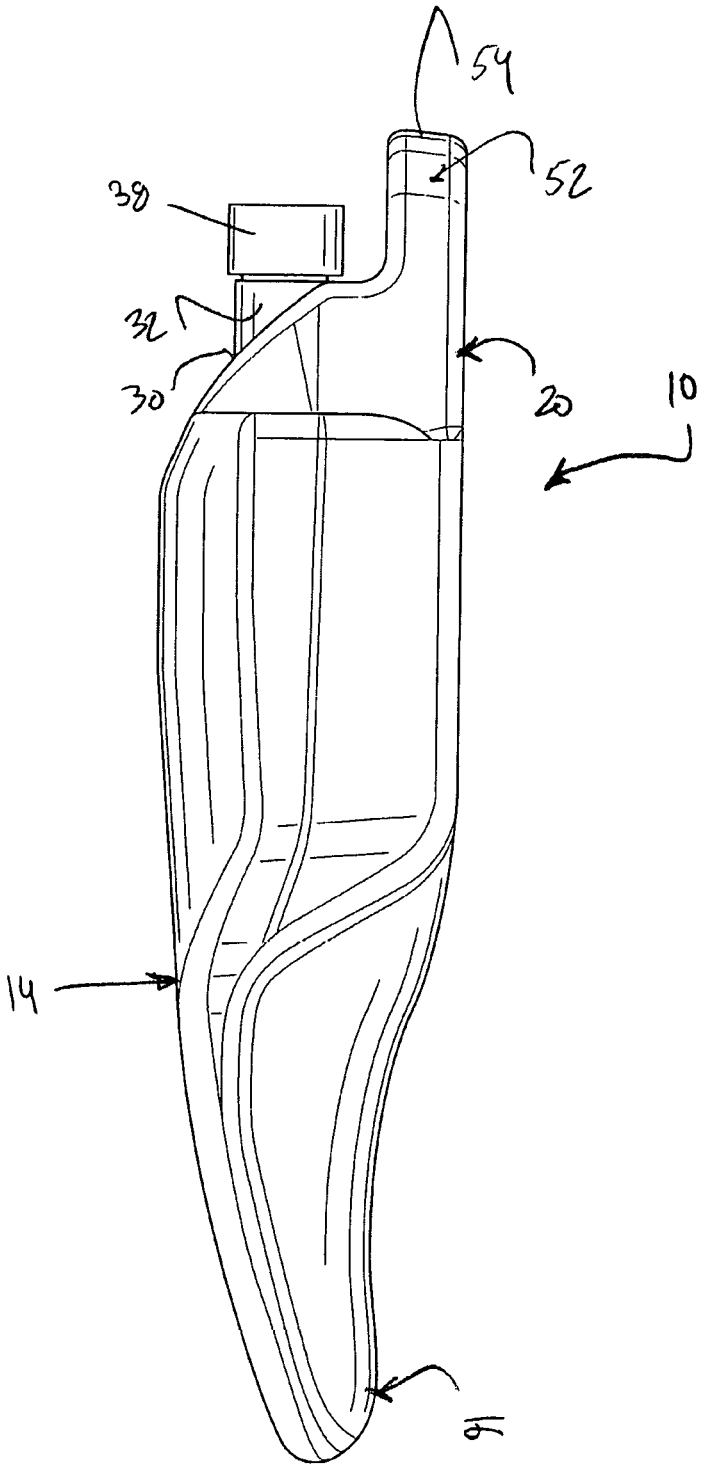
FIG. 4 illustrates a side view of the shoe tree.
Figure 5:
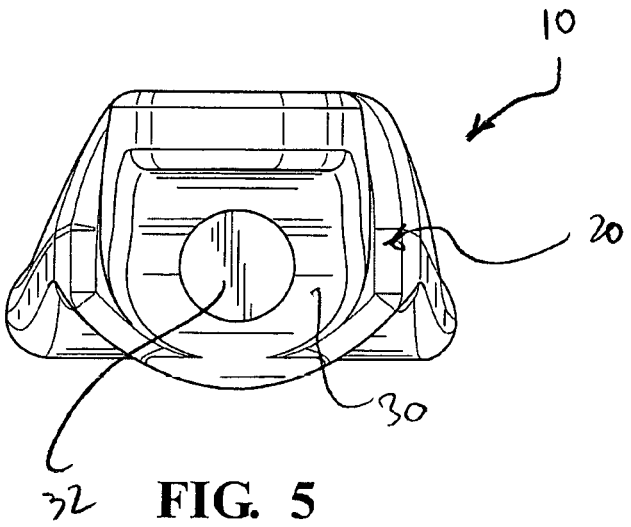
FIG. 5 illustrates a rear view of the shoe tree.
Figure 6:
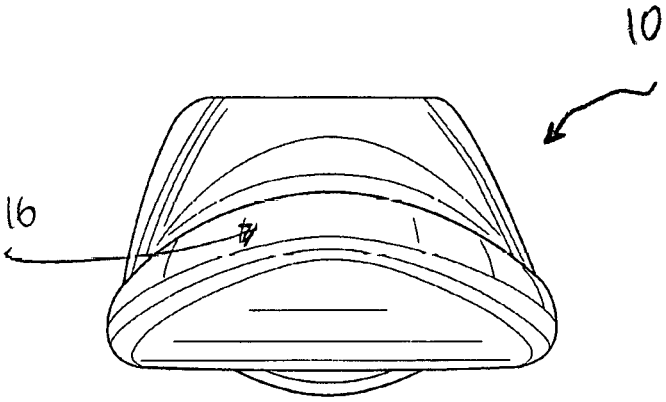
FIG. 6 illustrates a front view of the shoe tree.
Figure 7:
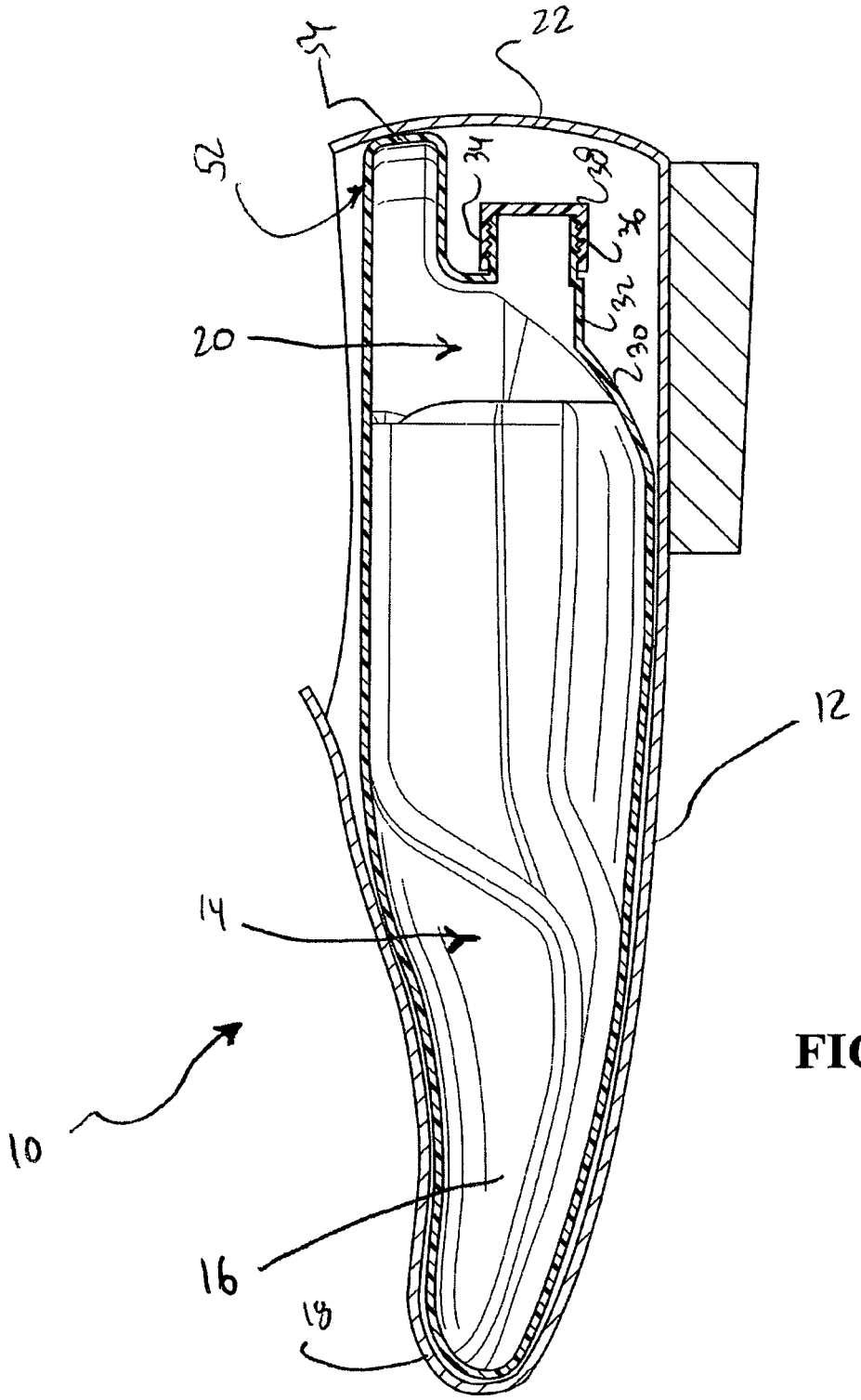
FIG. 7 illustrates a cross sectional view of the shoe tree.
Figure 8:
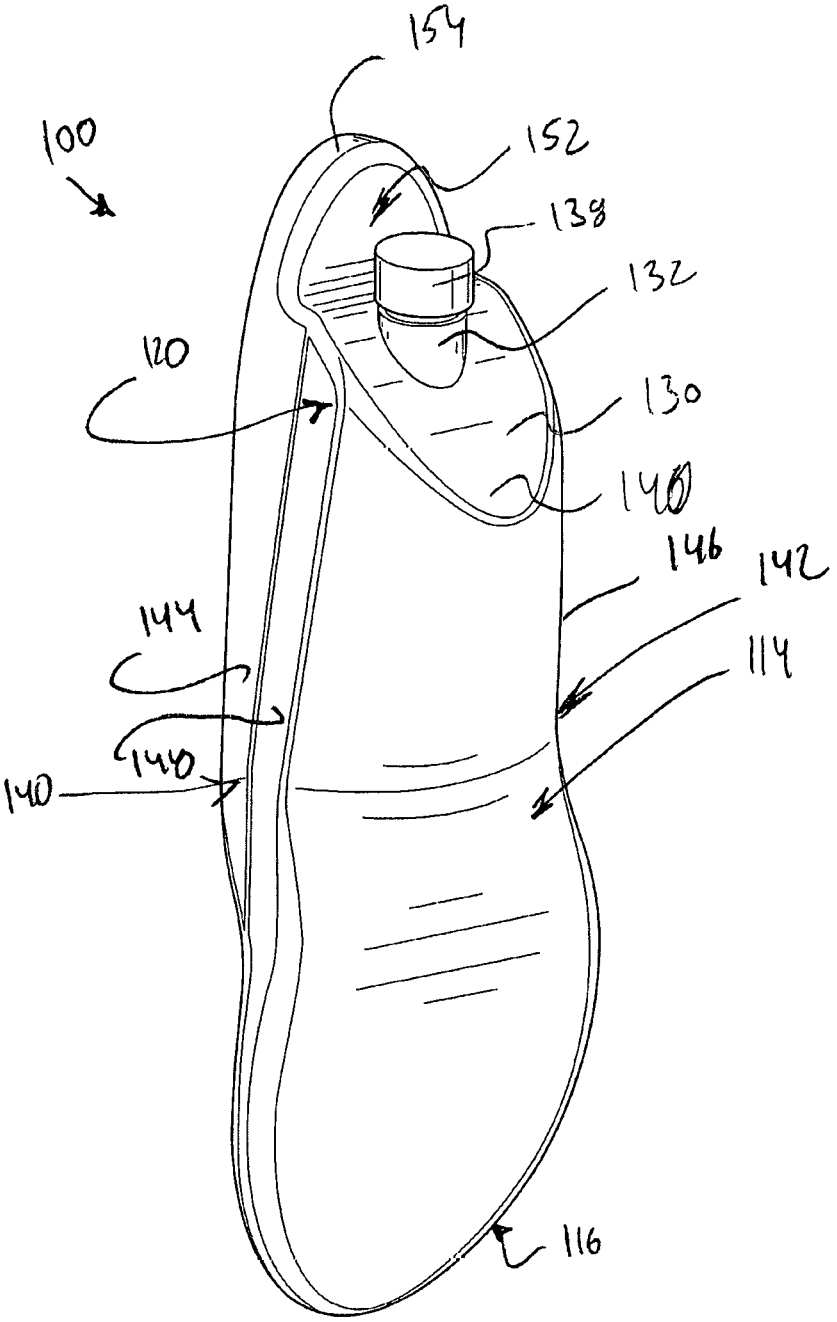
FIG. 8 illustrates a perspective view of an alternative embodiment of a shoe tree taken from a bottom part.
Figure 9:
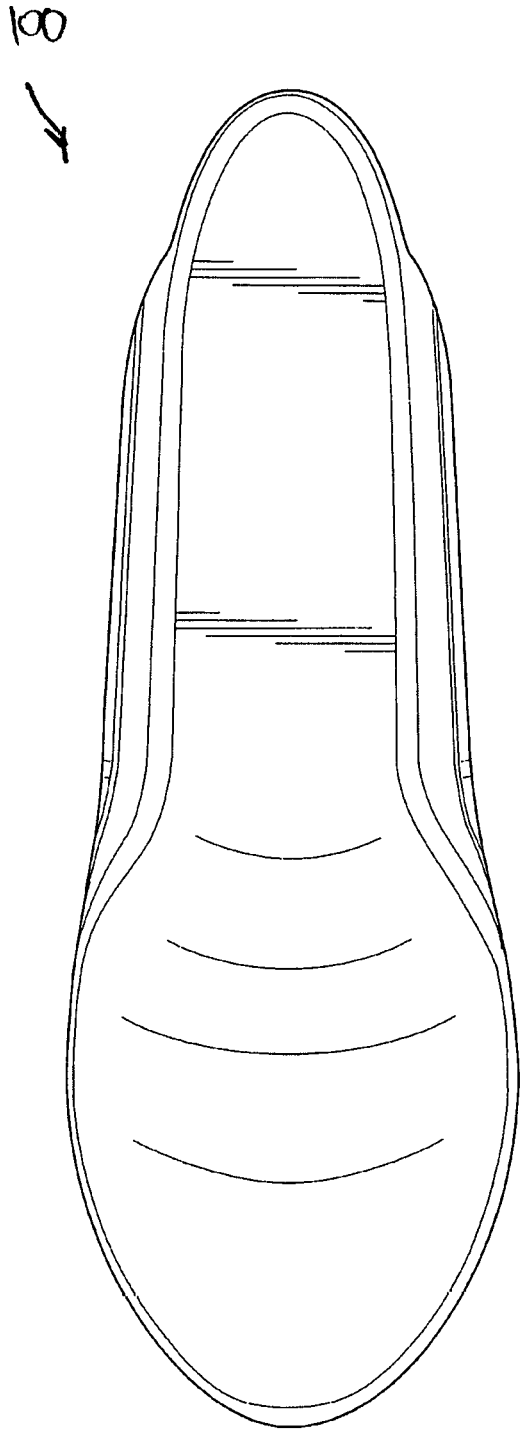
FIG. 9 illustrates a top view of the shoe tree.
Figure 10:
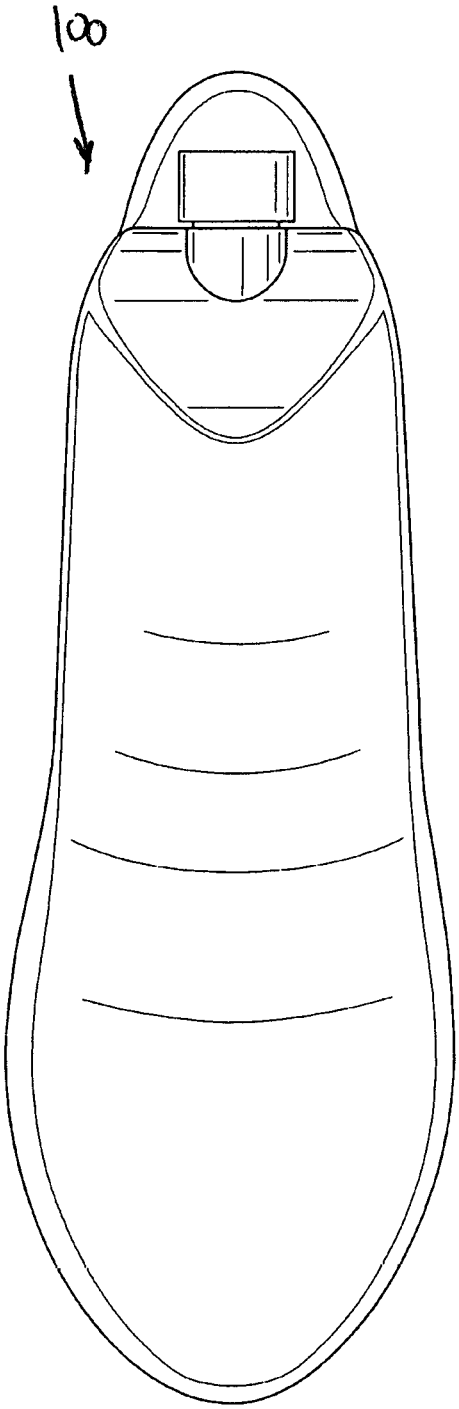
FIG. 10 illustrates a bottom view of the shoe tree.
Figure 11:
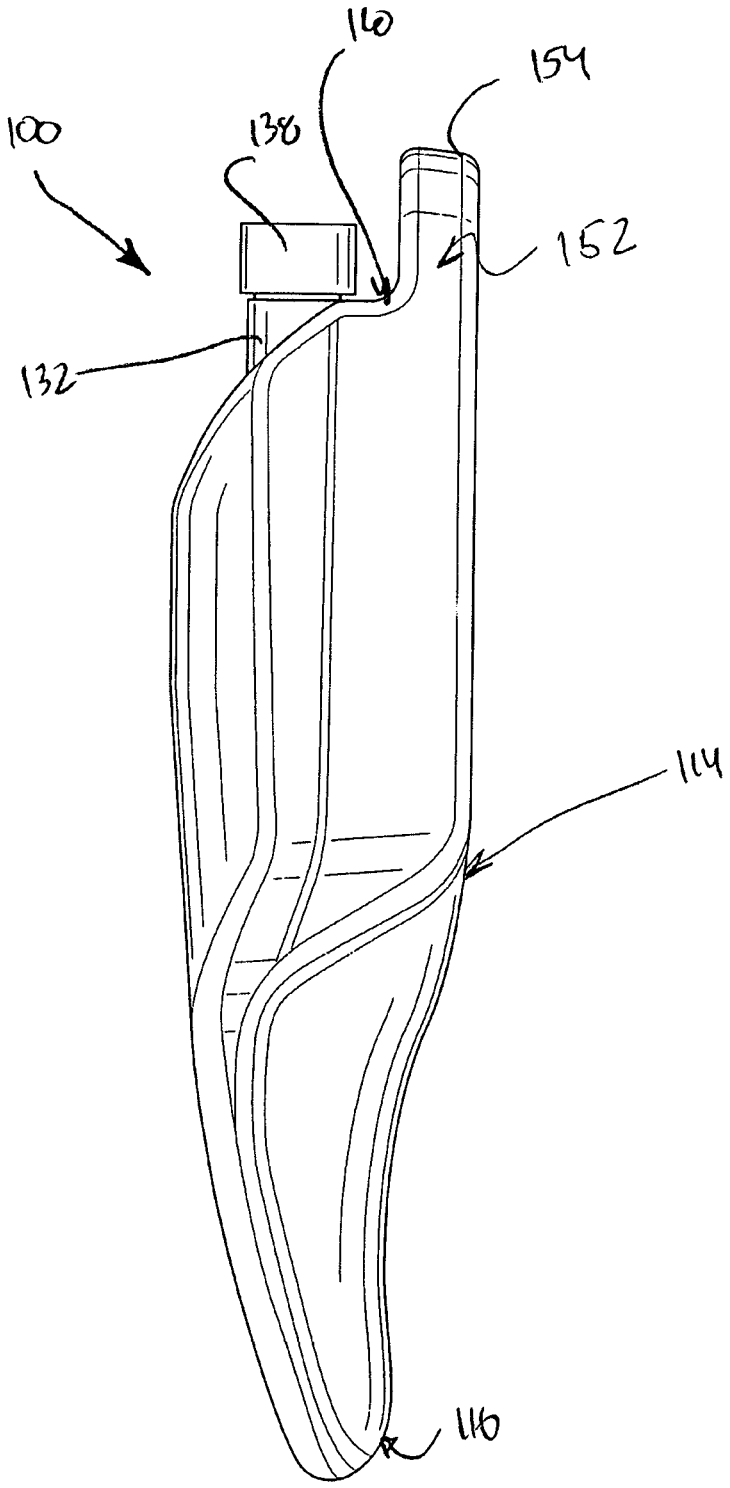
FIG. 11 illustrates a side view of the shoe tree.
Figure 12:
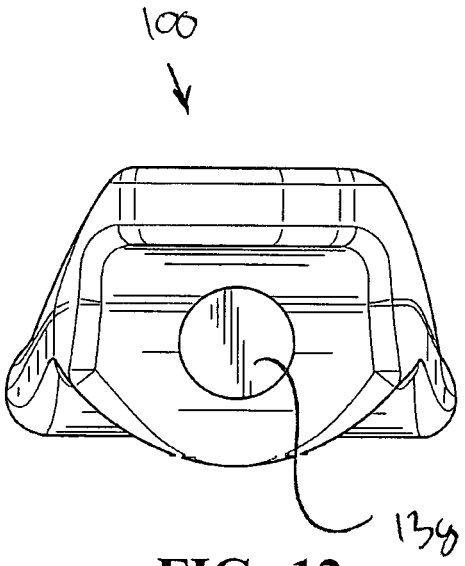
FIG. 12 illustrates a rear view of the shoe tree.
Figure 13:
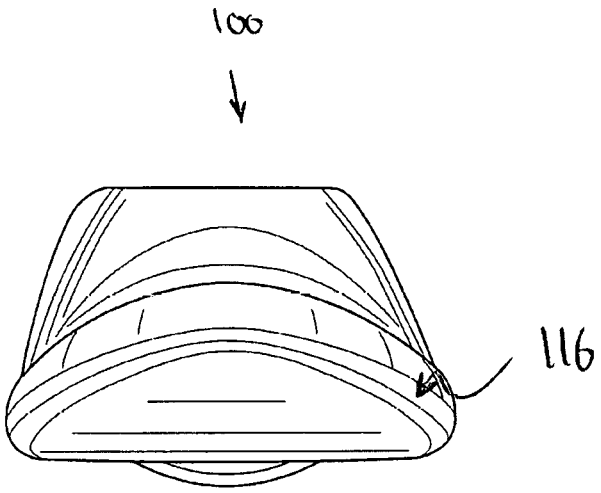
FIG. 13 illustrates a front view of the shoe tree.

Referring to FIGS. 1 through 7, wherein reference numerals indicate like or similar parts, a shoe tree of the present invention is generally shown at 10 in FIGS. 1 through 7. Referring to FIGS. 8 through 13, wherein reference numerals indicate like or similar parts, a shoe tree of an alternative embodiment of the present invention is generally shown at 100.

Referring now to FIGS. 1 through 7, the shoe tree 10 is insertable into a respective shoe 12 and is formed to support the shoe 12. The shoe tree 10 includes a body, generally indicated at 14. The body 14 is formed from a polymeric material and is hollow. The body 14 has a toe part, generally indicated at 16, insertable into a toe portion 18 of the shoe 12 and formed to support the toe portion 18 of the shoe 12 and a heel part 20 that is insertable into a heel portion 22 of the respective shoe 12 and formed to support the heel portion thereof.

The toe part 16 and the heel part 20 each present a toe bottom portion 24 and a heel bottom portion 26 separated by a step portion 28. The toe part 16 presents a wedge-shaped side wall 30 extending to a neck portion 32. The neck portion 32 includes first connectors 34 to mate with second connectors 36 of a cap 38 to engage the cap 38 with the neck portion 32 to keep fluids inside the shoe tree 10.

The toe part 16 presents side parts generally indicated at 40, 42 defining wings 44, 46 extending above and outwardly from sides panels 48, 50 to form a grabbing portions on each side of the toe part 16 to allow a user to grab the body 14 and insert the body 14 of the shoe tree 10 into the shoe 12. A flat section 17 at the heel bottom portion 26 is formed to stabilize the shoe tree 10 when it is inserted into the shoe 12.

The body 14 includes a handle, generally indicated at 52, presenting a semi-circular peripheral edge 54 to mate with the shoe 12. The handle 52 is integral with and extends from the toe part 16. The neck portion 32 is positioned below the handle 52. The handle 52 extends beyond the neck portion 32. The neck portion 32 is adaptable to receive and store fluids, such as water, to add weight to the shoe tree 10 to spread the weight of the shoe tree 10 to the shoe 12 to keep the shoe 12 in shape and eliminate wrinkles on the shoe 12.

Referring to FIGS. 8 through 13, a shoe tree of an alternative embodiment of the present invention is generally shown at 100. The shoe tree 100 includes a body, generally indicated at 114. The body 114 is formed from a polymeric material and is hollow. The body 114 has a toe part, generally indicated at 116, insertable into a toe portion 18 of the shoe 12 and formed to support the toe portion 118 of the shoe 12 and the heel part 120 that is insertable into the heel portion 22 of the respective shoe 12 and formed to support the heel portion thereof.

The toe part 116 and the heel part 120 each present a toe bottom portion 124 and a heel bottom portion 126 separated by a step portion 128. The toe part 116 presents a wedge-shaped side wall 130 extending to a neck portion 132. The neck portion 132 includes a cap 138 to engage the cap 138 with the neck portion 132 to keep fluids inside the shoe tree 100.

Alluding to the above, the wedge-shaped side wall 130 extends to a flat section 140 at the heel bottom portion 126 to stabilize the shoe tree 100 when it is inserted into the shoe 12. The toe part 116 presents side parts generally indicated at 140, 142 defining wings 144, 146 extending above and outwardly from sides panels 148, 150 to form a grabbing portions on each side of the toe part 116 to allow a user to grab the body 114 and insert the body 114 of the shoe tree 100 to the shoe 12.

The body 114 includes a handle, generally indicated at 152, presenting a semi-circular peripheral edge 154 to mate with the shoe 12. The handle 152 is integral with and extends from the toe part 116. The neck portion 132 is positioned below the handle 152. The handle 152 extends beyond the neck portion 132. The neck portion 132 is adaptable to receive and store fluids to add weight to the shoe tree 100 to spread the weight of the shoe tree 100 to the shoe 12 to keep the shoe 12 in shape and eliminate wrinkles on the shoe 12.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A shoe tree insertable into a respective shoe and formed to support the shoe, said shoe tree comprising:

a body having a toe part is insertable into a toe portion of the shoe and formed to support the toe portion of the shoe and a heel part that is insertable into a heel portion of the respective shoe and formed to support the heel portion thereof; and said body being a hollow in shape and defining a handle integral with and extending from said toe part and a neck portion of tubular configuration positioned below said handle with said handle extending beyond said neck portion with said neck portion adaptable to receive and store fluids to add weight to said shoe tree to spread the weight of said shoe tree to the shoe to keep the shoe in shape and eliminate wrinkles on the shoe.

2. The shoe tree as set forth in claim 1, wherein said body is formed from a polymeric material.

3. The shoe tree as set forth in claim 1, wherein said toe part presents a wedge shaped side wall extending to said neck portion.

4. The shoe tree as set forth in claim 1, wherein said handle presents a semi-circular peripheral edge to mate with the shoe.

5. The shoe tree as set forth in claim 1, wherein said toe part presents side parts defining wings extending above and outwardly from sides panels to form a grabbing portions on each side of said toe part to allow a user to grab said body and insert said body of said shoe tree into the shoe.

6. The shoe tree as set forth in claim 1, wherein said toe part and said heel part each present a toe bottom portion and heel bottom portion, respectively, separated by a step portion.

7. The shoe tree as set forth in claim 1, wherein said wedge shaped side wall extends to a flat section at said heel bottom portion to stabilize said shoe tree when it is inserted into the shoe.

8. The shoe tree as set forth in claim 3, wherein said neck portion include first connectors to mate with second connectors of a cap to engage said cap with said neck portion to keep fluids inside said shoe tree.

9. A shoe tree insertable into a shoe and formed to support the shoe, said shoe tree comprising:

a body formed from a polymeric material, said body having a toe part insertable into a toe portion of the shoe and formed to support the toe portion of the shoe and a heel part insertable into a heel portion of the shoe and formed to support the heel portion thereof;

said toe part and said heel part each presenting a toe bottom portion and a heel bottom portion separated by a step portion;

said toe part presenting a wedge shaped side wall extending to a neck portion; said neck portion including first connectors to mate with second connectors of a cap to engage said cap with said neck portion to keep fluids inside said shoe tree;

said wedge shaped side wall extending to a flat section at said heel bottom portion to stabilize said shoe tree when it is inserted into the shoe;

wherein said toe part presents side parts defining wings extending above and outwardly from sides panels to form a grabbing portions on each side of said of said toe part to allow a user to grab said body and insert said body of said shoe tree to the shoe;

said handle presents a semi-circular peripheral edge to mate with the shoe; and said body being a hollow in shape and defining a handle integral with and extending from said toe part and a neck portion of tubular configuration positioned below said handle with said handle extending below said neck portion with said neck portion adaptable to receive and store fluids to add weight to said shoe tree to spread the weight of said shoe tree to the shoe to keep the shoe in shape and eliminate wrinkles on the shoe.

* * * * *